US006887024B2

(12) United States Patent
Boss

(10) Patent No.: US 6,887,024 B2
(45) **Date of Patent: *May 3, 2005**

(54) SCORING OF BOUND SHEETS IN IMAGING SYSTEMS

(75) Inventor: Roland Boss, Guadalajara (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

This patent is subject to a terminal disclaimer.

(21) Appl. No.: 10/681,559

(22) Filed: Oct. 8, 2003

(65) Prior Publication Data

US 2004/0071528 A1 Apr. 15, 2004

Related U.S. Application Data

(63) Continuation of application No. 09/717,488, filed on Nov. 20, 2000, now Pat. No. 6,685,414.

(51) Int. Cl.[7] ..... B42B 9/00

(52) U.S. Cl. ..... 412/6; 270/52.18; 270/58.08; 412/16; 412/38; 493/396

(58) Field of Search ..... 412/1, 6, 7, 9, 412/16, 38; 270/52.18, 58.07, 58.08, 58.11; 493/396

(56) References Cited

U.S. PATENT DOCUMENTS

| | | | | | |
|---|---|---|---|---|---|
| 3,954,548 | A | * | 5/1976 | Polit | 156/477.1 |
| 4,386,926 | A | * | 6/1983 | Heller | 493/396 |
| 4,606,689 | A | * | 8/1986 | Wiholm | 412/3 |
| 5,308,208 | A | * | 5/1994 | Ranson | 412/5 |
| 6,099,225 | A | * | 8/2000 | Allen et al. | 412/32 |
| 6,142,721 | A | * | 11/2000 | Marsh | 412/1 |
| 6,550,513 | B2 | * | 4/2003 | Boss | 156/498 |
| 6,685,414 | B1 | * | 2/2004 | Boss | 412/6 |

* cited by examiner

*Primary Examiner*—Monica S. Carter

(57) ABSTRACT

A binding system in an imaging system includes an accumulator in which sheet material is accumulated in respective jobs to be bound. The binding system includes a binding assembly adapted and constructed to bind the sheet material together. A scoring member is connected to the binding assembly. The scoring member is adapted and constructed to form respective score patterns in sheet material received in the accumulator. The binding assembly can include a thermally low-mass heating element and a thermally high-mass cooling element.

18 Claims, 5 Drawing Sheets

SCORING OF BOUND SHEETS IN IMAGING SYSTEMS

CROSS-REFERENCE TO RELATED APPLICATION

This application is a continuation of U.S. utility application entitled, "Scoring of Bound Sheets in Imaging Systems," having Ser. No. 09/717,488, filed Nov. 20,2000 now U.S. Pat. No. 6,685,414, which is entirely incorporated herein by reference.

FIELD OF THE INVENTION

The present invention relates to document binding arrangements associated with imaging systems. More specifically, the present invention relates to scoring sheets, individually and in line, to be bound in an imaging system to improve the quality of bound documents.

BACKGROUND OF THE INVENTION

Imaging systems such as printers, fax machines, and copiers are virtually omnipresent, and can be found in homes and offices worldwide. The development of such systems has facilitated improvements in communication that have in turn fostered a sea change in the way people live and work. Telecommuting, paperless offices, and intra-office networks represent but a few examples of the advancements that have been made possible by modern imaging systems.

Imaging systems have become relatively sophisticated in response to consumer demands. It is not uncommon to find imaging systems associated with output systems capable of collating, sorting, and stapling groups of documents. One example of such an output system a 3000-sheet stapler/stacker, available from Hewlett-Packard Company, for high-capacity HP LaserJet printers. The 3000-sheet stapler/stacker, can be combined with the HP LaserJet 8100 printer to conveniently provide reliable, high-volume printing and finishing for professional-looking documents. Using the HP LaserJet 8100 printer, 3,000-sheet stapler/stacker, automatic duplexer and 2,000-sheet input tray together, users can quickly and easily print, staple and sort single or numerous copies of large documents on demand. Manuals, training packages and other lengthy printed materials that need to be updated frequently can now be created in-house, allowing businesses to save costs associated with outsourcing and inventory storage and control.

Various systems for binding groups of finished documents have arisen in parallel to the advancements in image production. Such systems enable in-house personnel to produce bound sets of materials from documents output from imaging systems. A variety of binding types are available, including spiral binding, flexible spine binding, and thermal binding.

In thermal binding processes, sheets of material are typically placed within a cover, with a thermoplastic spline inserted along an edge of the materials. The binder applies heat, or a combination of heat and pressure, to fuse the spline with the materials, thus forming a bound set.

While such bound sets provide convenience and acceptable appearance, they are often cumbersome to use. Fused splines and covers render the bound sets stiff and inflexible, making it difficult to open the pages of the set sufficiently. This can make reading or making entries onto pages cumbersome. Further, the binding process requires secondary operations, in some systems necessitating manually performed steps.

While known binding systems produce durable bound sets, the bulk and stiffness of the binding are unnecessary for collections of documents for which frequent reference is unlikely, such as printed sets of archived e-mails messages.

It can thus be seen that the need exists for a binding method and apparatus that results in a securely bound, easy-to-use set.

SUMMARY OF THE INVENTION

Accordingly, the present invention is directed to a binding system inline with an imaging system including an accumulator in which sheet material is accumulated in respective jobs to be bound. The binding system includes a binding assembly adapted and constructed to bind the sheet material together. A scoring member is connected to the binding assembly. The scoring member is adapted and constructed to form respective score patterns in sheet material received in the accumulator.

The binding assembly can include a thermally low-mass heating element and a thermally high-mass cooling element. The scoring member can be connected for motion with respect to the binding assembly, for example, by forming at least one bore in the binding assembly, and at least one guide post extending from the scoring member and received for reciprocation in the at least one bore in the binding assembly. At least one resilient biasing member, for example, a coil spring surrounding the guide post, can be disposed between the scoring member and the binding assembly. The scoring member can be constructed as an elongate wedge-shaped bar, a serrated edge, a series of pointed protrusions, or any configuration suitable for the material to be scored.

The binding assembly can include a frame assembly having a first frame member mounted generally parallel to a second frame member. The heating element can be mounted on a lower surface of the frame assembly. The binding assembly can also include a cooling element having a generally parallelepipedal lower portion extending downwardly from a generally parallelepipedal upper portion. The lower portion of the cooling element can be mounted for reciprocal movement between the first and second frame members of the frame assembly. At least one biasing member, for example, a coil spring, can be secured between at least one of the frame members of the frame assembly and the upper portion of the cooling element.

A method of binding sheet material is also set forth. The method can be practiced in an imaging system including an accumulator in which sheet material having at least one longitudinal edge is accumulated in respective jobs to be bound. In a first step, a first sheet of material is received in the accumulator. The first sheet of material is then scored substantially parallel to a longitudinal edge of the first sheet of material. Next, a second sheet of material is received in the accumulator at a position overlying the first sheet of material. The second sheet of material is scored substantially parallel to a longitudinal edge of the second sheet of material and bound to the first sheet of material. The step of scoring the second sheet of material can occur in synchronization with the step of binding the second sheet of material to the first sheet of material, whether before, after, or simultaneously.

The features of the invention believed to be patentable are set forth with particularity in the appended claims. The invention itself, however, both as to organization and method of operation, may be best understood by reference to the following description taken in conjunction with the accompanying drawings.

DETAILED DESCRIPTION OF THE INVENTION

Figure 1:
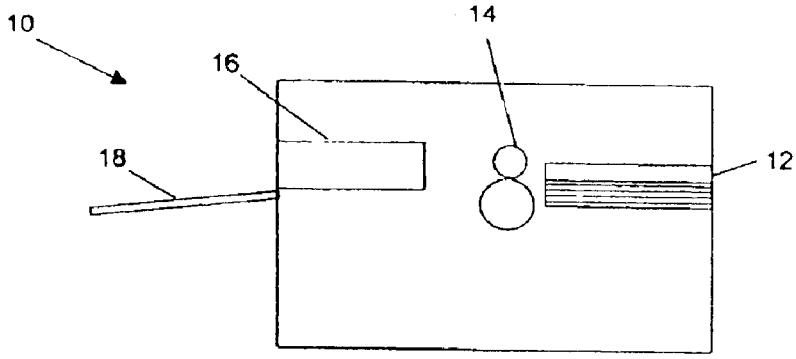
FIG. 1 is a schematic view of an imaging system in accordance with the principles of the present invention.

An imaging system 10 in accordance with the principles of the present invention is shown in FIG. 1. The imaging system 10 can be, for example, a copier, fax machine, or printer, such as a HEWLETT-PACKARD 5SI. The imaging system 10 can include a magazine 12 adapted to hold a plurality various sizes and types of sheet material. Sheet material from the magazine 12 can be fed into an imaging mechanism 14, where an image is transferred to the sheet material When the imaging system 10 is used to produce multiple-page documents, imaged sheets are collected in order at an accumulator 16. As will be appreciated by those of skill in the art, various transport mechanisms in the imaging system 10 can be used to deliver the desired sheet (cover or fill, etc.) to the appropriate section for processing. Once the document is complete, it is delivered to an outfeed section 18.

Figure 2:
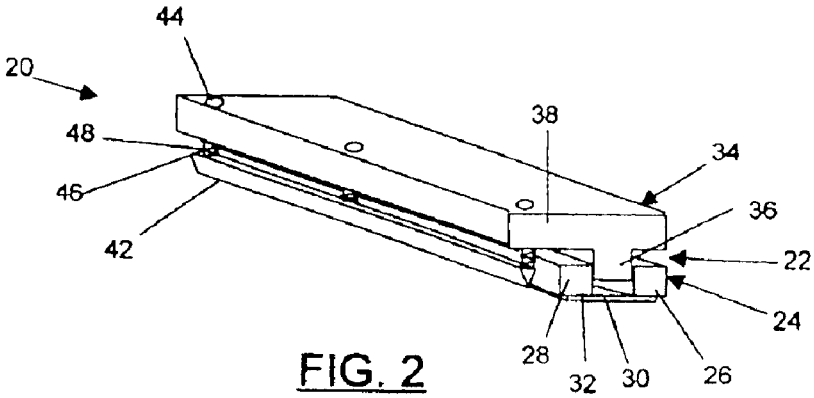
FIG. 2 is a schematic perspective view of a binding apparatus in accordance with the principles of the present invention.
Figure 3:
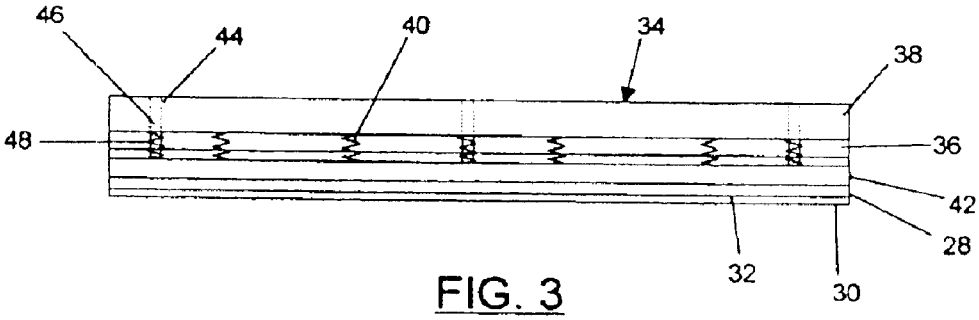
FIG. 3 is a front elevational view of the binding apparatus of FIG. 1.

The accumulator 16 is adapted and constructed to accommodate a binding system 20 as illustrated in FIGS. 2 and 3. The binding system 20 includes a binding assembly 22 that includes a frame assembly 24 having a first frame member 26 mounted generally parallel to a second frame member 28. A heating element 30, preferably a relatively thermally low-mass resistive heating element, can be mounted on a lower surface 32 of the frame assembly 24.

The binding assembly 22 include a cooling element 34 having a generally parallelepipedal lower portion 36 extending downwardly from a generally parallelepipedal upper portion 38. The cooling element 34 can be a passive element such as a heat sink, or actively cooled such as by internal coolant circulation. The lower portion 36 of the cooling element is mounted for reciprocal movement between the first frame member 26 and the second frame member 28 of the frame assembly 24. At least one biasing member, here illustrated as a plurality of coil springs 40, can be secured between at least one of the frame members 26, 28 of the frame assembly 24 and the upper portion 38 of the cooling element 34.

A scoring member 42 is connected to the binding assembly 22. The scoring member 42 is constructed as an elongate wedge-shaped bar, and is connected for motion with respect to the binding assembly 22. In the illustrated embodiment, the scoring member 42 is connected to the binding assembly 22 by the provision of at least one bore, here shown as a plurality of bores 44 in the upper portion 38 of the cooling element 34 of the binding assembly 22. At least one guide post, illustrated as a plurality of guideposts 46, extending from the scoring member 42 and are received for reciprocation in the respective bores 44. The scoring member 42 is biased away from the binding assembly 22 by a suitable biasing arrangement between the scoring member and the binding assembly. One suitable biasing arrangement is the provision of coil springs 48 surrounding the guide posts 46.

A method of binding sheet material in accordance with the principles of the present invention is illustrated in FIGS. 4 through 12. The illustrated method employs a binding system 20 as shown in FIGS. 2 and 3, within an accumulator 16 as shown in FIG. 1, although it is contemplated that the method can be practiced with apparatus differing physically from those in the illustrated examples.

Figure 4:
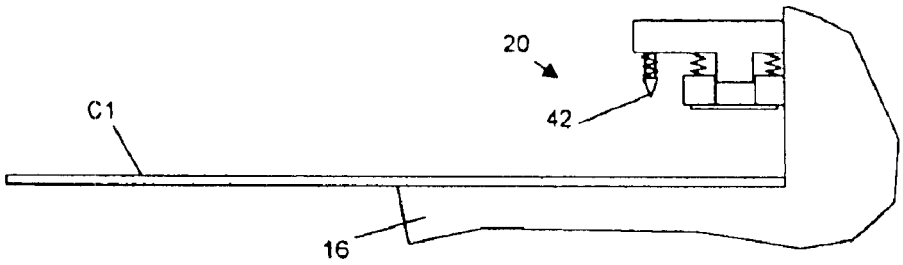
FIGS. 4 through 14 schematically illustrate the FIG. 2 binding apparatus used to bind a document.
Figure 5:
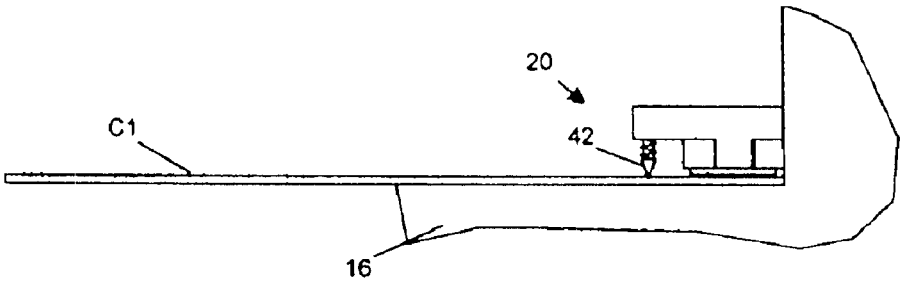
Figure 6:
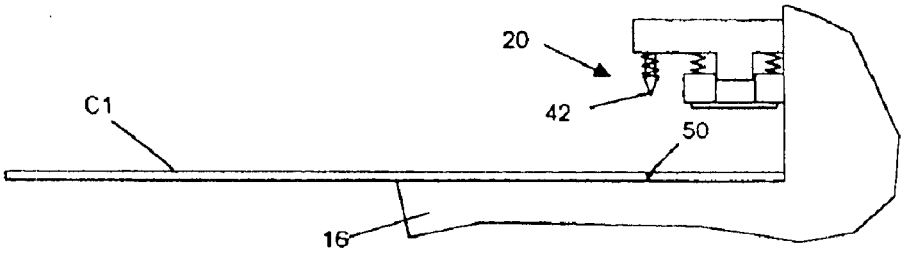

In a first step shown in FIG. 4, a sheet of material, here illustrated as a first cover C1, is received in the accumulator 16. As shown in FIG. 5, the binding system 20 is moved downwardly into contact with the cover C1 until the scoring member 42 presses into the surface of the cover C1. As seen in FIG. 6, the contact between the scoring member 42 and the cover C1 forms a score pattern 50 substantially parallel to a longitudinal edge of the cover C1. The accumulator 16 is now ready to receive additional sheets of material.

Figure 7:
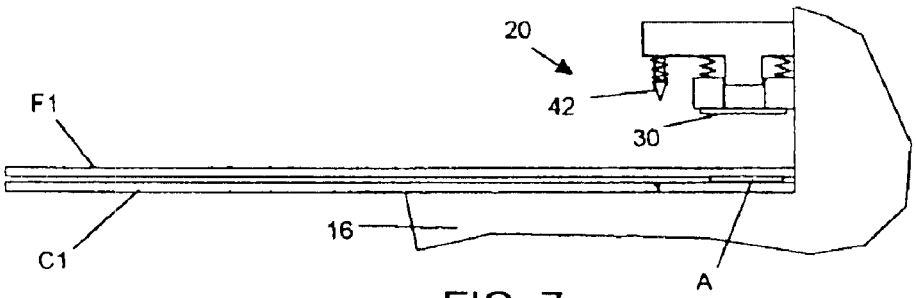

As shown in FIG. 7, the next sheet of material, here illustrated as a first fill sheet F1, is received in the accumulator 16, and the heating element 30 is pre-heated to its operating temperature. The temperature of the heating element 30 is dictated by the nature of the adhesive A used to bind the sheet together. If the adhesive A is provided as toner printed onto the sheet F1, the operating temperature of the heating element 30 must be adequate to melt the toner. The precise temperature range will depend upon a variety of factors, including the nature of the sheet material, the thermal mass of the heating element, the pressure applied, etc. In the illustrated example using standard toner, it is contemplated that the operating temperature will be in a range of 120° C. to 160° C.

Figure 8:
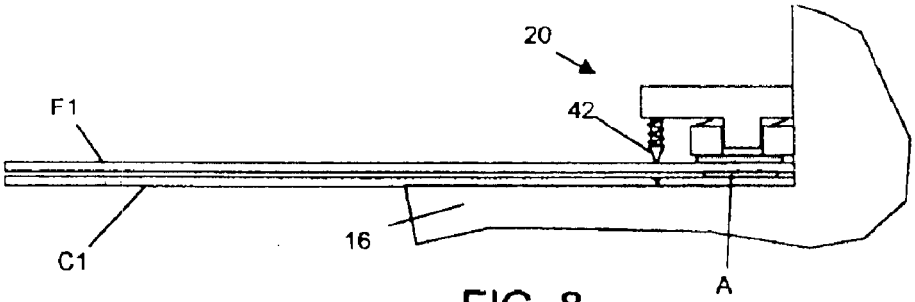
Figure 9:
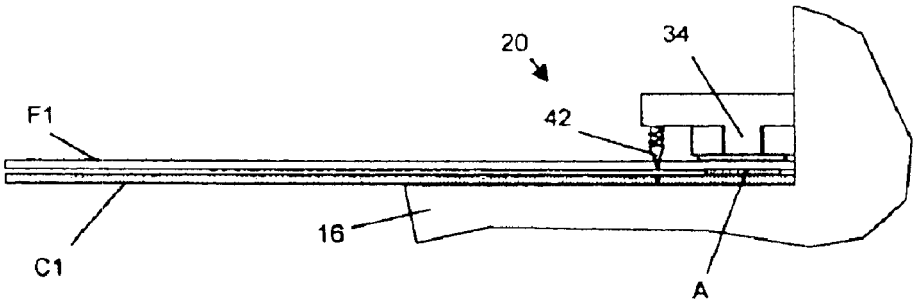
Figure 10:
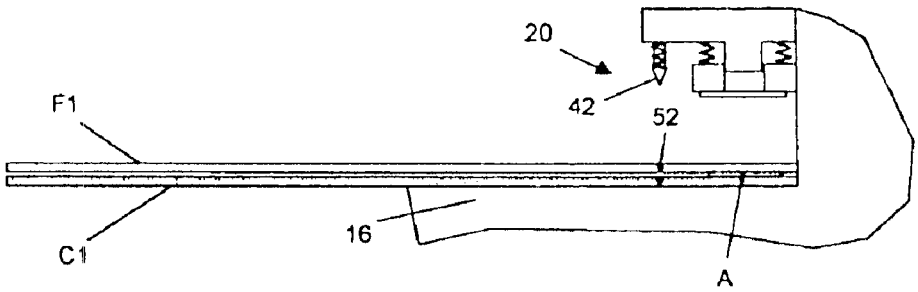

As shown in FIG. 8, the binding system 20 is moved downwardly until the heating element 30 contacts the surface of the sheet F1 in an area above the adhesive A, melting the adhesive and forming a bond between the sheet F1 and the cover C1. As the binding system 20 continues its downward travel, the heating element 30 is deactivated, and the cooling element 34 contacts the heating element 30 to cool the surface of the sheet F1 in an area above the adhesive A, cooling and completing the bond. Simultaneously, the scoring member 42 presses into the surface of the sheet F1, forming a score pattern 52 substantially parallel to a longitudinal edge of the sheet F1 and overlying the score pattern 50 on the cover C1. As shown in FIG. 10, the system 20 is then lifted into a position to receive additional sheets.

Figure 11:
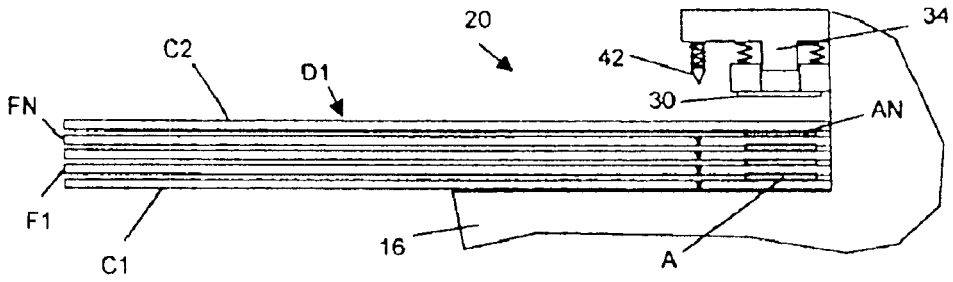
Figure 12:
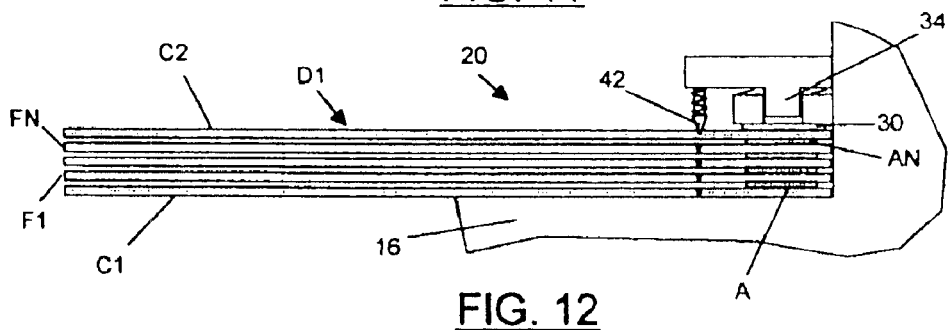
Figure 13:
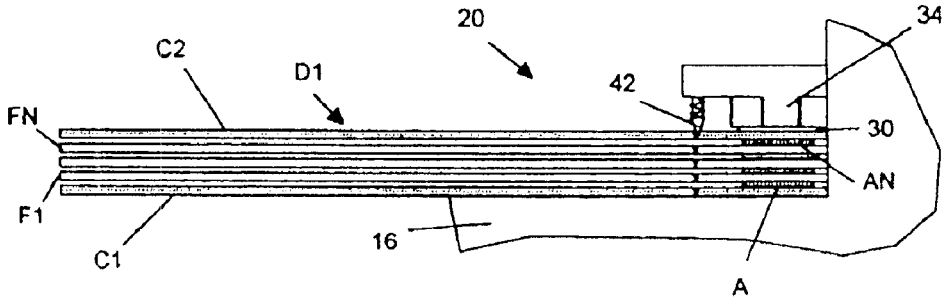
Figure 14:
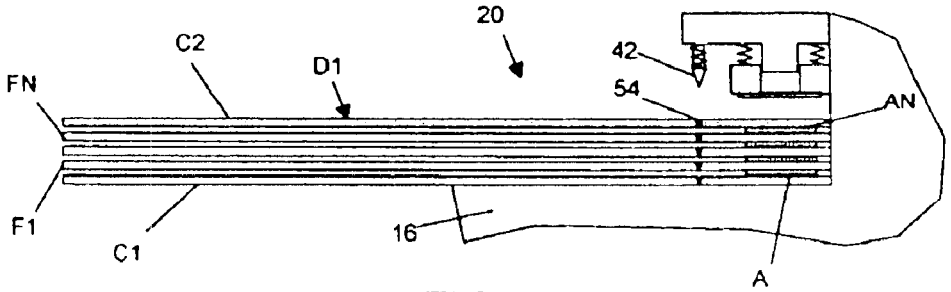

The process described in conjunction with FIGS. 7 through 10 is repeated until, as shown in FIG. 11, all pages of the document D1 have been scored and bound together. The document D1 includes the cover C1 and fill sheets F1 through FN. A second cover sheet C1 is received in the accumulator 16, and the heating element 30 is pre-heated to its operating temperature. As shown in FIG. 11, the binding system 20 is moved downwardly until the heating element 30 contacts the surface of the cover C2 in an area above the adhesive AN, melting the adhesive and forming a bond between the sheet FN and the cover C2. As the binding system 20 continues its downward travel, the heating element 30 is deactivated, and the cooling element 34 contacts the surface of the cover C2 in an area above the adhesive A, cooling and completing the bond. Simultaneously, the scoring member 42 presses into the surface of the cover C2, forming a score pattern 54 substantially parallel to a longitudinal edge of the cover C2 and overlying the score pattern on the sheet EN. The system 20 is then lifted its FIG. 14 position, enabling the completed document D1 to be transported to the outfeed section 18.

Figure 15:
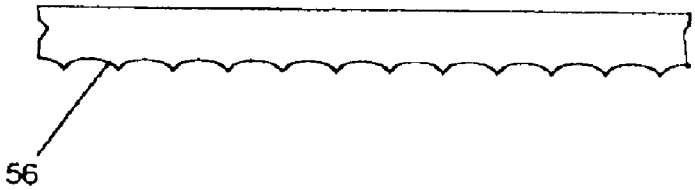
FIGS. 15 and 16 schematically illustrate alternative configurations for a scoring member.
Figure 16:
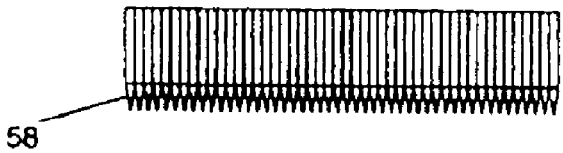

FIGS. 15 and 16 illustrate alternative configurations for the scoring member. In FIG. 15, a serrated edge 56 is provided to form a score pattern consisting of regular depressions in the material. In FIG. 16, a series of pointed protrusions 58 are provided to form a pattern of perforations or indentations. Of course, the configuration of the scoring member will be chosen based upon the nature and thickness of the particular sheet material to be bound.

In the illustrated example, all of the sheets, including the covers, are scored during the binding process. This protects the binding, since the score patterns distribute peeling forces along their length, preventing tern them from reaching and weakening the bond between the sheets of material. This allows heavier covers and fill sheet material to be used than would otherwise be practical with known binding techniques, increasing the perceived quality of the document.

It is contemplated that the principles of the present invention are applicable to a wide variety of binding processes, such as applied adhesives or mechanical binding. Further, binding material, if used, can be applied to less than all of the sheets of material to be bound. Also, although the score patterns are shown in alignment with one another, it is contemplated that the score patterns could be offset from one another, for example, arced inwardly from the binding to accommodate use in thicker document sets. The present invention is illustrated as being in-line within the housing of the imaging system, but could be provided as a separate module. The scoring pressure could be altered within a single document to accommodate different materials, or to provide perforations for removable sheets. Pressure variation could be accomplished, for example, by varying the degree of extension of the scoring member.

Although the present invention has been described with reference to specific embodiments, those of skill in the art will recognize that changes may be made thereto without departing from the scope and spirit of the invention as defined by the appended claims.

What is claimed is:

1. A binding system, comprising:

a binding assembly adapted and constructed to bind sheet material together, the binding assembly including a heating element and a cooling element that is displaceable between a first position in which the cooling element is separated from the heating element to a second position in which the cooling element contacts the heating element; and a scoring member connected to the binding assembly that is adapted and constructed to form respective score patterns in sheet material received by the system.

2. A binding system in accordance with claim 1, wherein the heating element comprises a thermally low-mass heating element.

3. A binding system in accordance with claim 1, wherein the cooling element comprises a thermally high-mass cooling element.

4. A binding system in accordance with claim 1, wherein the scoring member is connected for motion with respect to the binding assembly.

5. A binding system in accordance with claim 4, further comprising the following:

at least one bore formed in the binding assembly; and at least one guide post extending from the scoring member and received for reciprocation in the at least one bore in the binding assembly.

6. A binding system in accordance with claim 5, further comprising at least one resilient biasing member disposed between the scoring member and the binding assembly.

7. A binding system in accordance with claim 6, wherein the at least one resilient biasing member comprises at least one coil spring surrounding the at least one guide post.

8. A binding system in accordance with claim 1, wherein the scoring member comprises a scoring surface selected from a group consisting of an elongate wedge-shaped bar, a bar having a serrated edge, and a generally linear series of pointed protrusions.

9. A binding system in accordance with claim 1, wherein the binding assembly further comprises a frame assembly including a first frame member mounted generally parallel to a second frame member.

10. A binding system in accordance with claim 9, wherein the heating element is mounted on the frame assembly.

11. A binding system in accordance with claim 10, wherein the heating element comprises a thermally low-mass heating element that is mounted on a bottom surface of the frame assembly.

12. A binding system in accordance with claim 9, wherein the cooling element has a generally parallelepipedal lower portion that extends downwardly from a generally parallelepipedal upper portion, and the lower portion of the cooling element is mounted for reciprocal movement between the first and second frame members of the frame assembly.

13. A binding system in accordance with claim 12, further comprising at least one biasing member secured between at least one of the frame members of the frame assembly and the upper portion of the cooling element.

14. A binding system in accordance with claim 13, wherein the at least one biasing member comprises at least one coil spring.

15. A method of binding sheet material, comprising:

receiving a first sheet of material in a binding system;

scoring the first sheet of material;

receiving a second sheet of material in the binding system at a position adjacent the first sheet of material;

scoring the second sheet of material; and binding the second sheet of material to the first sheet of material in the binding system.

16. The method of claim 15, wherein scoring the second sheet of material occurs substantially simultaneously with binding the second sheet of material to the first sheet of material.

17. The method of claim 15, wherein binding the second sheet of material to the first sheet of material comprises applying a heat-activated binding material to a surface of one of the first and the second sheets of material, heating the heat-activated binding material, and cooling the heat-activated binding material between the first sheet of material and the second sheet of material.

18. The method of claim 17, wherein heating the heat-activated binding material comprises heating the heat-activated binding material with a heating element of a binding system and wherein cooling the heat-activated binding material comprises cooling the heat-activated binding material with a cooling element of the binding system that is displaceable relative to the heating element.

* * * * *